US009272325B2

(12) United States Patent
Zhu

(10) Patent No.: US 9,272,325 B2
(45) Date of Patent: Mar. 1, 2016

(54) ENVIRONMENT SERVO TYPE CLEAN METAL CASTING MOLD

(75) Inventor: Shucheng Zhu, Nanyang (CN)

(73) Assignee: NANYANG XINGZHI PATENT TECHNOLOGY SERVICE CO., LTD, Nanyang, Henan (CN)

( * ) Notice: Subject to any disclaimer, the term of this patent is extended or adjusted under 35 U.S.C. 154(b) by 531 days.

(21) Appl. No.: 13/881,894

(22) PCT Filed: Nov. 23, 2010

(86) PCT No.: PCT/CN2010/079021

§ 371 (c)(1),
(2), (4) Date: Jul. 26, 2013

(87) PCT Pub. No.: WO2012/055127

PCT Pub. Date: May 3, 2012

(65) Prior Publication Data

US 2013/0299671 A1 Nov. 14, 2013

(30) Foreign Application Priority Data

Oct. 26, 2010 (CN) ..... 2010 1 0527798

(51) Int. Cl.
*B22C 9/06* (2006.01)
*B22D 7/06* (2006.01)
*B22D 27/04* (2006.01)

(52) U.S. Cl.
CPC ..... *B22C 9/065* (2013.01); *B22D 7/064* (2013.01); *B22D 27/04* (2013.01)

(58) Field of Classification Search
CPC ..... B22C 9/065; B22D 7/064; B22D 27/04
See application file for complete search history.

(56) References Cited

U.S. PATENT DOCUMENTS 6,827,124 B2 * 12/2004 Garlock ..... B22D 27/045 164/122.1
6,896,030 B2 * 5/2005 Soderstrom ..... B22D 27/045 164/122.1

FOREIGN PATENT DOCUMENTS

| | | | |
|---|---|---|---|
| CN | 1227147 | A | 9/1999 |
| CN | 1526495 | A | 9/2004 |
| CN | 2659597 | Y | 12/2004 |
| CN | 2690077 | Y | 4/2005 |
| CN | 10173395 | A | 6/2010 |
| JP | 08-141703 | A | 6/1996 |

OTHER PUBLICATIONS

International Search Report issued in PCT/CN2010/079021, dated Jul. 21, 2011.

* cited by examiner

*Primary Examiner* — James Sanders
(74) *Attorney, Agent, or Firm* — Rossi, Kimms & McDowell LLP

(57) ABSTRACT

An environment servo type clean metal casting mold has a casting mold body with an ingate. The casting mold body includes a cold bottom mold plate and a peripheral mold plate that is connected with the cold bottom plate. The peripheral mold plate is provided with a vertical temperature break servo device. The temperature of the vertical temperature abrupt servo device contacting with the cooling metal varies in the vertical direction, hence the liquid metal has rapid heat emission, crystallization and solidification.

10 Claims, 3 Drawing Sheets

ENVIRONMENT SERVO TYPE CLEAN METAL CASTING MOLD

This application is a U.S. National Phase Application of PCT International Application PCT/CN2010/079021, filed on Nov. 23, 2010, which is based on and claims priority from CN 201010527798.7, filed on Oct. 26, 2010, the contents of which is incorporated in its entirety by reference.

TECHNICAL FIELD

The present invention relates to an environment servo type clean metal casting mold which belongs to the field of metallurgical casting equipment technology.

BACKGROUND OF THE INVENTION

It is well known in the art that after ordinary mold casting, in the upper partial central position of the casted ingot, there exists a V-shape region enriching of segregates and inclusions. The segregates and inclusions in this area are hard to be removed because of being located in the upper central portion, which will affect the quality of the metal generated and is detrimental to metal containing few segregations and inclusions when being rolled out. What's more, the metal bound with the segregates and inclusions cannot be easily separated from impurities, thereby affecting the improvement of the metal yield.

Currently, most of metal ingots in the world are still casted in this way, and thus a lot of metal cannot be achieved with a high quality and cannot be used effectively and fully, which cause much energy wasting.

In order to achieve clean metal, a secondary melting refining procedure, such as electroslag remelting is needed. This causes a great wasting of manpower and resource. Additionally, a great pressure is also imposed on the environment.

This does not meet the development requirements of energy saving and environmental protection, which is the great loss of the metal smelting industry.

In addition, electroslag remelting secondary melting refining procedure requires a great deal of electrical energy, meanwhile, low efficiency also restricts the large scale industrial production. What's worse, the slag material contains large amount of calcium fluoride which will pollute environment, so a de-dust and de-fluorine device must be provided. And the electric arc could seriously damage the crystallizer. A crystallizer casting mold in the manner of electroslag furnace remelting can only refine scores of furnace of steel, which increases the cost of production.

Recently, there exists a clean metal ingot mold. The process for cooling of the bottom mold plate is accelerated in the form of water-cooling. All of the peripheral mold plate or part thereof is water-cooled. The heat preservation dead head portion and the heat preservation portion of the peripheral mold plate keeps at a high temperature to ensure its directional solidification. During the process of directional solidification, the directional crystallization start from the water-cooled mold plate to the high temperature mold plate. The inclusions and segregates were driven to the direction of uncrystallized region in the process of forming crystals. The liquid metal near the high temperature mold plate becomes solidification at last because of being far away from low-temperature. Most of the inclusions and segregates in the liquid metal are enriched in the region that contacts the high temperature mold plate, so the alloy segregations and inclusions can be easily removed with flame or other processing methods, thus achieving the purpose of transferring, removing segregations and inclusions from the liquid metal and getting purified ingot.

However, since the directional solidification is very susceptive to the surroundings, if the portion that does not need to be solidified is exposed to low temperature, it will inevitably solidify preferentially. This will affect not only the movement direction of the alloy segregations, inclusions, but also the comprehensive generation of columnar crystals in the process of directional solidification, which is not favoring to improve the crystal quality and product quality.

SUMMARY OF THE INVENTION

The present invention provides an environment servo type clean metal casting mold having a long service life, which can reduce emissions of pollutants and improve production efficiency. The circumferential ambient temperature will be automatically adjusted according to the needs of the process of oriented crystallization.

An environment servo type clean metal casting mold includes a mold body with an ingate, wherein the mold body comprises a cold bottom mold plate and a peripheral mold plate in connection with the cold bottom mold plate. A vertical temperature servo abrupt device is set on the peripheral mold plate.

The vertical temperature servo abrupt device includes a mobile heat preservation internal mold disposed in the peripheral plate. The mobile heat preservation internal mold is connected movably with the peripheral mold plate. The mobile heat preservation internal mold is connected movably with the lifting guide mechanism set outside the mold body. The mobile heat preservation internal mold is a sealed frame composed of thermal insulation board and is conformal to the shape of the inner wall of the peripheral mold plate.

The vertical temperature servo abrupt device comprises multilayer densely arranged water-cooled channels disposed within the peripheral mold plate. The multilayer densely arranged water-cooled channels are disposed independently to avoid being effected by each other.

The vertical temperature servo abrupt device includes multilayer densely arranged hot and cold channels within the peripheral mold plate. The multilayer densely arranged hot and cold channels circulate cold water or high temperature gas therethrough, and the channels are independently set from each other.

The vertical temperature servo abrupt device includes water-cooled channels and high-temperature gas channels which are arranged alternately in the peripheral mold plate. The water-cooled channels and high-temperature gas channels are set independently to avoid being effected by each other.

The vertical temperature servo abrupt device includes a component of the temperature change module and a constant temperature module.

In the present invention the vertical temperature servo abrupt device is set on the peripheral mold plate connected with the cold bottom mold plate. The temperature of vertical servo abrupt device will change suddenly when it contacts with the cool metal. In the beginning process of the solidification, the vertical temperature servo abrupt device is at an initial state. The whole molten liquid metal in circumferential direction and above direction is at a high temperature. Rapid cooling and crystalline solidification begins from the liquid metal in contact with the bottom mold plate because of the significant difference between the upper and lower temperature. With crystallization slowly moving up, the vertical temperature servo abrupt device start to work. The contact temperature of the metal to be crystallized is divided into two distinct temperatures in the vertical direction. One temperature is close to that of the liquid metal and contacts the uncrystallized part, helping to keep the liquid external environment at a high temperature, so as to avoid lateral crystallization. Another cooling temperature close to that of the cold mold plate and contacts the crystallized part, so it can absorb the heat of solidified part rapidly and greatly accelerate the process of the metal solidification. On a horizontal line of the peripheral mold plate, the temperature of the uncrystallized liquid metal in contact with the plate is extremely high, preventing the horizontal heat transfer from occurring. When the molten metal contact with the peripheral mold plate just solidified, the temperature around the metal suddenly dropped to the vicinity of the temperature in the cooling mold plate under the control of the vertical temperature servo abrupt device. The entire peripheral mold plate and the bottom mold plate share a great temperature difference with the solidified metal under the horizontal line, resulting in rapid heat transfer and fast crystallization. Viewing from the entire metal solidification process, the vertical temperature servo abrupt device not only ensure a directional solidification external environment in which the uncrystallized part do not crystallize laterally, and the vertical thermal conductivity is fast, but also ensure the columnar crystal generated is unbroken and distributed homogeneously, and meantime, there rarely appears overlapping joint and bridging phenomenon on the crystals. Furthermore, since the effect of directional crystallization is good enough, most of the inclusions and segregations within the liquid metal are more enriched in the upper region of the metal casting mold after the directional solidification of the liquid metal, which is very easy to be handled and the metal ingot will be cleaner.

BRIEF DESCRIPTION

In the following, the present invention will be further described in conjunction with the accompanying drawings.

DESCRIPTION OF THE PREFERRED EMBODIMENT

Embodiment 1

Figure 1:
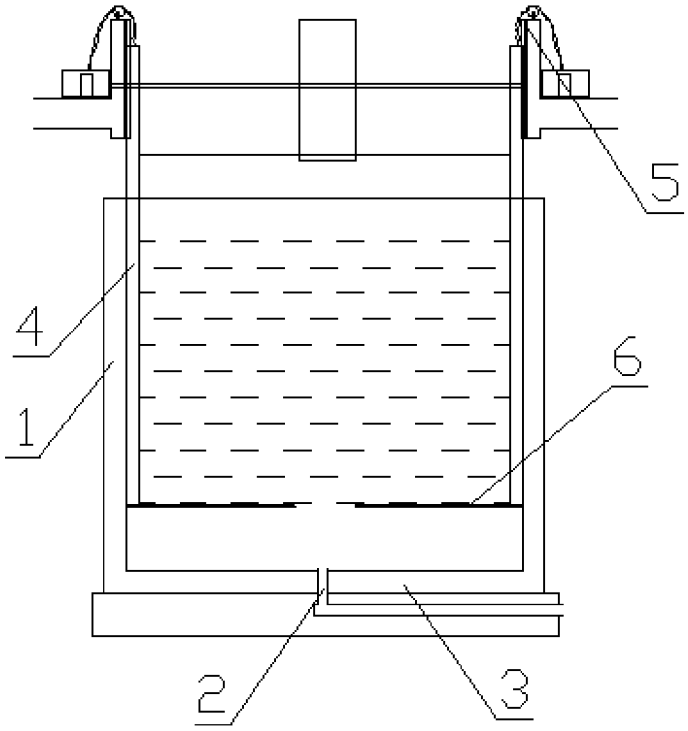
FIG. 1 is a schematic diagram according to a first embodiment of the present invention.
Figure 2:
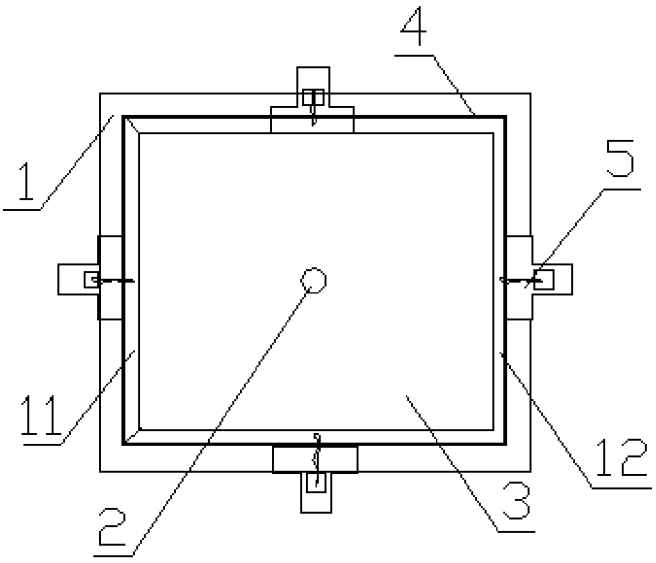
FIG. 2 is a plan view of the first embodiment of the present invention.

As shown in FIGS. 1 and 2, an environment servo clean metal casting mold includes a mold body with an ingate 2 is provided, wherein the casting old body comprises a cold bottom mold plate 3 and the peripheral mold plate 1 in connection with the cold bottom mold plate 3. The cold bottom mold plate 3 is a water-cooled or an air-cooled mold plate. The vertical temperature servo abrupt device is set on the peripheral mold plate 1. The peripheral mold plate 1 is a cold mold plate such as a water-cooled or an air-cooled mold plate. The vertical temperature servo abrupt device includes a mobile heat preservation internal mold 4 set in the peripheral mold plate 1. The mobile heat preservation internal mold 4 is connected movably with the peripheral mold plate 1. The mobile heat preservation internal mold 4 is connected movably with the lifting guide mechanism 5 set outside the casting mold body. The mobile heat preservation internal mold is a sealed frame which is conformal to the shape of inner wall of peripheral mold plate.

During the beginning process of solidification, the vertical temperature servo abrupt device is in an initial state. The mobile heat preservation internal mold 4 contacts the bottom mold plate. The whole molten liquid metal in circumferential direction and the above direction is at a high temperature. Solidification begins from the liquid metal in contact with the bottom mold plate. With the slowly upper shift of the crystal plane, under the upward pressure from the crystal plane and the tensile force from the lifting guide mechanism 5, the mobile heat preservation internal mold 4 moves upward, so that the crystalline solid portion is exposed to the cold peripheral mold plate 1, rapidly radiating and greatly accelerating the process of the metal solidification. The external environment of the liquid portion is still a high temperature zone surrounded by the insulation board. The horizontal heat transfer does not occur substantially, thus preventing the portion in contact thereto from lateral crystallization. Above a solid-liquid crystal surface 6, the temperature of the uncrystallized liquid metal is close to the lateral ambient temperature, which ensures that the horizontal heat transfer does not occur.

Lateral ambient temperature below the solid-liquid crystalline surface 6 directly contacts with the cold circumferential template, and suddenly drops to the temperature of the cooling mold plate. The significant temperature difference results in rapid heat transfer and quick crystallization. When the mobile heat preservation internal mold moves up from the casting mold, the ingot process is complete.

Embodiment 2

Figure 3:
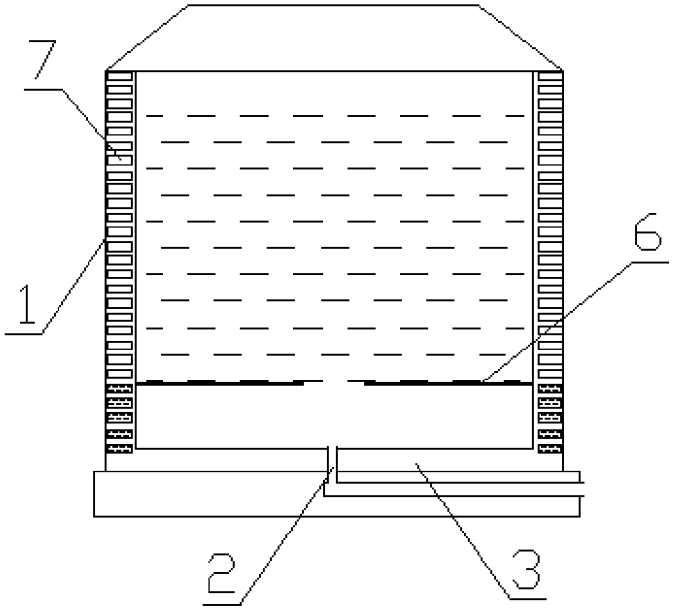
FIG. 3 is a schematic diagram according to the second embodiment of the present invention.

As shown in FIG. 3, an environment servo type clean metal casting mold includes a mold body with an ingate 2. The casting mold body comprises a cold bottom mold plate 3 and the peripheral mold plate 1 in connection with cold bottom mold plate 3. The vertical temperature servo abrupt device is set on the peripheral mold plate 1. The vertical temperature servo abrupt device includes multilayer closely-spaced water-cooled channels 7 which are arranged independently from each other.

When the cooling process starts, multi-layer water-cooled channels do not access to the cold water, peripheral mold plate is in a high temperature state because of absorbing the heat from the liquid metal. With the formation of crystals from the bottom upward, the independent cooling channels will be filled with the circulating cold water from the bottom upward layer by layer depending on the position of the crystal plane, thus achieving the purpose that the horizontal ambient temperature beneath the surface of solid-liquid crystalline 6 suddenly drops because of the independent cooling channel being filled with circulating cold water, while the temperature above the solid-liquid crystalline surface 6 is essentially the same. The higher the solid-liquid crystal surface 6 upwards, the more water-cooled channels will be filled with water, and the larger area where the solidified metal will contact with low temperature, the faster thermal conductivity will be.

Embodiment 3

Figure 4:
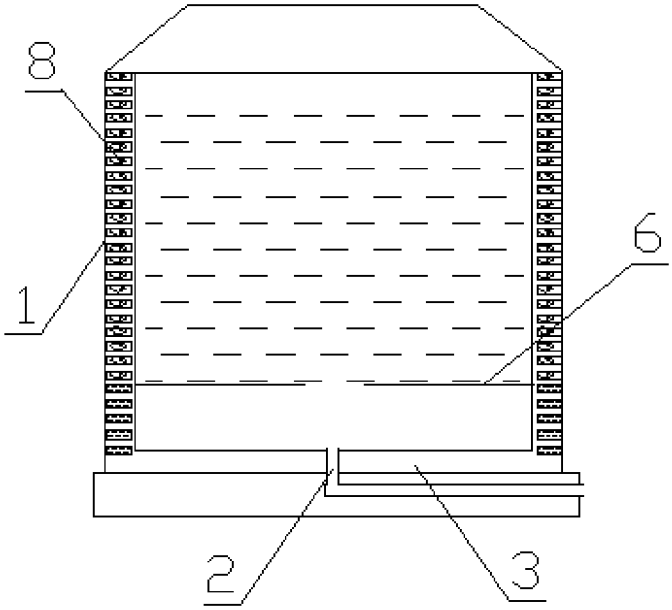
FIG. 4 is a schematic diagram according to the third embodiment of the present invention.

As shown in FIG. 4, an environment servo type clean metal casting mold includes a mold body with an ingate 2. The casting mold body comprises a cold bottom mold plate 3 and the peripheral mold plate 1 in connection with cold bottom mold plate 3. The vertical temperature servo abrupt device is set on the peripheral mold plate 1. The vertical temperature servo abrupt device includes multilayer closely-spaced hot and cold channel 8 which are arranged independently in the peripheral mold plate 1. Cold water or hot gases is circulated through the multilayer closely-spaced hot and cold channel 8. When the cooling process starts, all of the said multilayer closely-spaced hot and cold channels 8 will be filled with high-temperature gas, and the temperature is close to that of the liquid metal. After the start of solidification, the crystallization begins from the bottom upward, and the solid-liquid crystal plane 6 gradually moves upwards. The multilayer closely-spaced hot and cold channels 8 below the solid-liquid crystal plane 6 will circulates cold water therethrough layer by layer, and high-temperature gas will pass through the channels above the solid-liquid crystal surface.

The lateral ambient temperature beneath the solid-liquid crystal surface 6 suddenly drops because of the independent cooling channels are filled with circulating cold water. While the temperature above the solid-liquid crystalline surface 6 is essentially the same. The higher the solid-liquid crystal surface 6 upwards, the more water-cooled channels will be filled with water, and the larger area where the solidified metal will contact with the low temperature area, the faster thermal conductivity will be.

Embodiment 4

Figure 5:
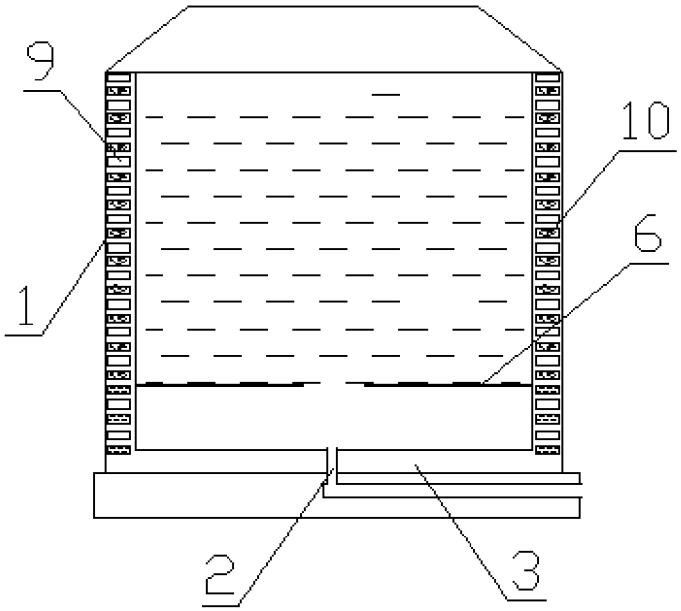
FIG. 5 is a schematic diagram according to the forth embodiment of the present invention.

As shown in FIG. 5, an environment servo type clean metal casting mold includes a mold body with an ingate 2. The casting mold body comprises a cold bottom mold plate 3 and a peripheral mold plate 1 in connection with cold bottom mold plate 3. The vertical temperature servo abrupt device is set on the peripheral mold plate 1. The vertical temperature servo abrupt device includes water-cooled channel 9 and high-temperature channel 10 which are arranged alternately in the peripheral mold plate 1. The water-cooled channel 9 and high-temperature channel 10 are independently arranged in order to avoid their being affected by each other. When the cooling process starts, all of the water-cooled channels won't circulate water, while all of the high-temperature channels will be filled with high-temperature gas, and the temperature is close to that of the liquid metal. After the start of solidification, the crystallization begins from the bottom upward, and the solid-liquid crystal plane 6 gradually moves upwards. The water-cooled channels 9 below the solid-liquid crystal plane 6 will circulates cold water therethrough layer by layer, and high-temperature gas will continuously pass through the high-temperature channels above the solid-liquid crystal surface.

The lateral ambient temperature beneath the solid-liquid crystal surface 6 suddenly drops because of the water-cooled channels are filled with circulating cold water. While the ambient temperature above the solid-liquid crystalline surface 6 is essentially the same. The higher the solid-liquid crystal surface 6 upwards, the more water-cooled channels will be filled with water, and the larger area where solidified metal will contact with low temperature, the faster thermal conductivity will be.

Embodiment 5

Figure 6:
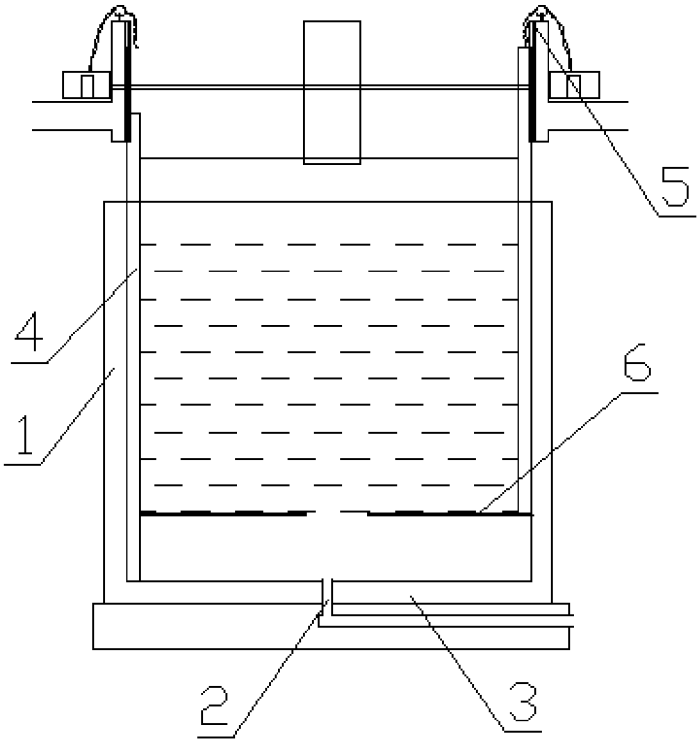
FIG. 6 is a schematic diagram according to the fifth embodiment of the present invention.

As shown in FIGS. 6 and 2, an environment servo type clean metal casting mold includes a mold body with an ingate 2. The mold body is composed by cold bottom mold plate 3 and the peripheral mold plate 1 in connection with the cold bottom mold plate 3. The cold bottom mold plate 3 is water-cold or air-cooled mold plate. The vertical temperature servo abrupt device is set on the peripheral mold plate 1. The peripheral mold plate 1 is cold mold plate such as water-cold or air-cooled mold plate.

The vertical temperature servo abrupt device includes a mobile heat preservation internal mold 4 set in the peripheral mold plate 1. The heat preservation internal mold 4 includes a component of the temperature change module 12 and a constant temperature module 11. The component of the temperature change module 12 and the constant temperature module 11 include a sealed frame which is conformal to the shape of inner wall of peripheral mold plate consisted of heat preservation plates.

During the beginning process of solidification, the vertical temperature servo abrupt device is in a initial state. The component of the temperature change module 12 and the constant temperature module 11 contact the bottom mold plate. The whole molten liquid metal in circumferential direction and above direction is at a high temperature. Solidification begins from the liquid metal in contact with the bottom mold plate. With the slow upper shift of the crystal plane, under the upward pressure from the crystal plane and the tensile force from the lifting guide mechanism 5, the component of the temperature change module 12 moves upward, and the position of the constant temperature module 11 is not changed. So the crystalline solid portion is exposed to the cold peripheral mold plate 1 and cools rapidly, and greatly accelerates the process of the metal solidification. The external environment is still a high temperature zone surrounded by the heat preservation board. The horizontal heat transfer does not occur substantially, thus preventing the uncrystallized portion contacting with the board from lateral crystallization. As the external environment of one side of the casting mold is at a high temperature all along, it tends to be in a post-crystallization state. After the directional solidification of the liquid metal, most of the inclusions and segregations within the liquid metal are more concentrated in the upper region of the metal casting mold that is connected to the top of a constant temperature module 11. The area is quite small, and the impurities are very concentrated, which make the impurities removal is very easy to handle, and the metal ingot is also cleaner.

What is claimed is:

1. An environment servo type clean metal casting mold including a mold body with an ingate, wherein the mold body comprises a cold bottom mold plate and a peripheral mold plate in connection with the cold bottom mold plate, wherein a vertical temperature servo abrupt device is set on the peripheral mold plate; and wherein the vertical temperature servo abrupt device includes a mobile heat preservation internal mold disposed in the peripheral plate, the mobile heat preservation internal mold is connected movably with the peripheral mold plate, the mobile heat preservation internal mold is connected movably with a lifting guide mechanism set outside the mold body, and the mobile heat preservation internal mold is a sealed frame composed of thermal insulation board and is conformal to the shape of the inner wall of the peripheral mold plate.

2. An environment servo type clean metal casting mold of claim 1, wherein the vertical temperature servo abrupt device comprises multilayer densely arranged water-cooled channels disposed within the peripheral mold plate, and the multilayer densely arranged water-cooled channels are disposed independently to avoid being effected by each other.

3. An environment servo type clean metal casting mold of claim 1, wherein the vertical temperature servo abrupt device includes multilayer densely arranged hot and cold channels within the peripheral mold plate, and the multilayer densely arranged hot and cold channels circulate cold water or high temperature gas therethrough, and wherein the channels are independently set from each other to avoid being effected by each other.

4. An environment servo type clean metal casting mold of claim 1, wherein the vertical temperature servo abrupt device includes water-cooled channels and high-temperature gas channels which are arranged alternately in the peripheral mold plate, and the water-cooled channels and high-temperature gas channels are set independently to avoid being effected by each other.

5. An environment servo type clean metal casting mold of claim 1 wherein the vertical temperature servo abrupt device includes a component of the temperature change module and a constant temperature module.

6. An environment servo type clean metal casting mold of claim 1 wherein the vertical temperature servo abrupt device includes a component of the temperature change module and a constant temperature module.

7. An environment servo type clean metal casting mold of claim 2 wherein the vertical temperature servo abrupt device includes a component of the temperature change module and a constant temperature module.

8. An environment servo type clean metal casting mold of claim 3 wherein the vertical temperature servo abrupt device includes a component of the temperature change module and a constant temperature module.

9. An environment servo type clean metal casting mold of claim 4 wherein the vertical temperature servo abrupt device includes a component of the temperature change module and a constant temperature module.

10. An environment servo type clean metal casting mold of claim 5 wherein the vertical temperature servo abrupt device includes a component of the temperature change module and a constant temperature module.

* * * * *